US005404917A

United States Patent [19]

Gheysen

[11] Patent Number: 5,404,917

[45] Date of Patent: Apr. 11, 1995

[54] SINGLE-SPOOL WEAVE WITHOUT COLOR MIXING

[75] Inventor: Nico Gheysen, Izegemstraat, Belgium

[73] Assignee: N.V. Michel Van De Wiele, Kortrijk-Marke, Belgium

[21] Appl. No.: 17,635

[22] Filed: Feb. 12, 1993

[30] Foreign Application Priority Data

Feb. 20, 1992 [BE] Belgium ..... 09200179

[51] Int. Cl.[6] ..... D03D 27/06

[52] U.S. Cl. ..... 139/398; 139/21

[58] Field of Search ..... 139/21, 398, 397

[56] References Cited

U.S. PATENT DOCUMENTS

| | | | |
|---|---|---|---|
| 3,327,738 | 6/1967 | Sabbe | 139/398 |
| 3,519,032 | 7/1970 | Sabbe | 139/398 |
| 4,756,340 | 7/1988 | Janssen | 139/398 X |
| 5,085,252 | 2/1992 | Mohamed et al. | 139/DIG. 1 |

FOREIGN PATENT DOCUMENTS

| | | |
|---|---|---|
| 896102 | 1/1983 | Belgium . |
| 4012235 | 12/1990 | Germany . |

*Primary Examiner*—Andrew M. Falik

*Attorney, Agent, or Firm*—Brumbaugh, Graves, Donohue & Raymond

[57] ABSTRACT

Method for single-spool weaving of a face-to-face fabric with bound-in dead pile which avoids color mixing at transitions from one pile thread color to another. When a color transition occurs through a pile thread bound into the bottom fabric by weft threads 1, 2, 3 and 4 before the transition (at weft thread 4) becomes active after the transition, this pile thread is successively guided to assume positions relative to the subsequent four shots 5, 6, 7 and 8 as follows: below, below, above and below, respectively. In another situation, in which the color transition occurs through a pile thread which was active before the transition (at weft thread 4) is bound in the top fabric after the transition by pile threads 5, 6, 7 and 8, this pile thread is made to assume positions relative to the previous four shots 1, 2, 3 and 4 as follows: above, below, above and above, respectively. The disclosed weaves ensure against to different colors ever occurring between two inner shots.

8 Claims, 3 Drawing Sheets

SINGLE-SPOOL WEAVE WITHOUT COLOR MIXING

BACKGROUND OF THE INVENTION

The invention relates to a new single-spool weave for face-to-face weaving by which color mixing is avoided.

Single spool or single shuttle weaving for-face-to-face pile fabrics is a weaving process whereby in successive machine cycles one weft is alternately inserted in bottom fabric and in top fabric, by forming alternately consecutive single sheds for the bottom, then for the top fabric. By this weaving method, the pile yarns need only be raised or lowered in two positions for both working pile and incorporation of dead pile: (1) under the weft (bottom position) or (2) above the weft (top position). A typical feature of this weaving method is that each weft yarn carries a pile row.

More particularly, in the case of single-spool weaves with bound-in dead pile, in which a binder warp working in a two shot up—two shot down sequence (referred to as 2/2) and a tension warp working in a one shot up—one shot down sequence (referred to as 1/1) are used, a certain mixing of the colors always occurs. This mixing is due to the fact that pile threads of a different color lie between two inner shots. This problem, which underlies this invention, is illustrated in the prior art FIGS. 1–5. As is well-known in the art, in face-to-face weaving it is necessary to weave together a top fabric portion and a bottom fabric portion to produce a final product. Both the top fabric portion and the bottom fabric portion have bound-in dead pile, which is bound by inner and outer weft thread alternately disposed in the top and bottom fabric. The top fabric and the bottom fabric have two levels respectively, the backside and the pile side. The inner shots are disposed between the top and bottom fabrics, and the outer shots are disposed outside the top and bottom fabrics. As can be seen in FIGS. 1–5, the inner shots are numbered 1, 4, 5 and 8; and the outer shots are numbered 2, 3, 6 and 7.

FIG. 1 shows diagrammatically a single-spool woven face-to-face fabric, in which the weave of the active pile threads is a 1/1 weave, and in which a pile thread 9 which was active over the first four shots 1, 2, 3, 4 is bound into the bottom fabric 30 after the fourth shot 4, and another pile thread 10 which was previously bound into the bottom fabric 30 becomes active pile thread after the fourth shot 4. In the top fabric 32, both pile thread 9 and pile thread 10 appear between shot 3 and shot 5. The differing colors of the two pile threads mean that color mixing is obtained at that place in the top fabric. As is well-known in the art, as shot 3 is located on the back of the top fabric 32 and shot 5 is located at the pile side of the top fabric 32 by the separation of the tension warp 34, the action of the binder warp 36 is that shot 5 tends to lie under shot 3. When the top and bottom fabrics are afterwards separated by the diagrammatically illustrated cutter blades 38, because the cut end of pile thread 10 of the top fabric has a color different from the cut end of pile thread 9 of the top fabric, a color mixing effect results. The color contour is not neat and this is particularly objectionable when a color transition between two color fields has to be made to form one pile row with tuft of same color which should appear in the pattern as a color line extending in weftwise direction.

FIG. 2 again shows a single-spool woven face-to-face fabric with a 1/1 V-weave for the active pile threads, in which a pile thread 11 which was active over the first four shots 1, 2, 3, 4 is bound into the top fabric after the fourth shot 4, and another pile thread 12 which was previously bound into the top fabric becomes active pile thread after the fourth shot 4. In the bottom fabric, both pile thread 11 and pile thread 12 appear between shot 4 and shot 6. Their differing colors mean that color mixing is obtained at that place in the bottom fabric. Although in FIG. 2, a crossing point of binding warp lies between shot 4 and shot 6, shot 4 tends to lie above shot 2, allowing shot 6 to lie along shot 2, with the consequence that the pile leg 5 to 6 of the end 12 coincides with leg 4 to 5 of pile thread 11. As the two legs of different color both lie between shots 4 and 6, it is well-known that color mixing would occur. It is also well-known that there would be no color mixing between shots 6 and 7, however, because shots 6 and 7 belong to the bottom and top fabrics, respectively, and pile thread 11 is bound to the top fabric after shot 5.

FIG. 4 shows a single-spool woven face-to-face fabric with a 1/1 V-weave for the active pile threads, in which a pile thread 13 which was active over the first four shots 1, 2, 3, 4 is bound into the top fabric after the fourth shot 4, and another pile thread 14 which was previously bound into the bottom fabric becomes active pile thread after the fourth shot 4. In the bottom fabric, both pile thread 13 and pile thread 14 appear between shot 4 and shot 5. These two pile threads 13 and 14, referred to as "double workers", run below shot 4 in the bottom fabric to above shot 5 in the top fabric. Even if, according to a known method (see FIG. 5), the double workers of FIG. 4 are not utilized, a color mixing still occurs at the level of shot 4.

A known solution to the problem of color mixing is that only a 1/1 weave is used for the base weave. The inlaid yarns consequently come to lie less above one another, and a better alignment between the different color fields is obtained. A disadvantage of this is, however, that the back of the fabrics becomes less attractive, due to the fact that the inlaid yarns cannot lie as closely together.

SUMMARY OF THE INVENTION

The object of the invention is to provide a new weave which avoids the above-mentioned color mixing when there are color transitions, so that a 1/1 weave as the base weave—with the above-mentioned disadvantage—is no longer necessary in order to improve the alignment between different color fields.

The subject of the invention is adapted weaves for a number of situations for the pile threads. The annoying color mixing is avoided if the specified adapted weave is used for a color transition in each of these situations.

The weaves are indicated by indicating the position of a pile thread relative to four successive weft threads. This position is either below or above a weft thread and is indicated by the letters B and A, respectively, for four successive shots.

The weaves normally used for the pile threads (see FIGS. 1, 2, 4) can be indicated as follows:

For the active pile threads 11, 12, 13 which are bound into the top fabric: ABAB;

For the active pile threads 9, 10, 14 which are bound into the bottom fabric: ABAB;

For the pile threads 11, 12, 13 which are bound into the top fabric: AABA;

For the pile threads 9, 10, 14 which are bound into the bottom fabric: BABB.

The adapted weaves according to the invention are as follows for the situations indicated for the pile threads:

for the active pile threads which are bound into the top fabric, and after the four shots which are indicated here are not active: ABAA;

for the active pile threads which are bound into the bottom fabric, and before the four shots which are indicated here were not active: BBAB.

BRIEF DESCRIPTION OF THE DRAWINGS

The characteristics and the advantages of the new weaves according to the invention are illustrated with reference to the description which follows of a number of examples, which are illustrated by means of the accompanying drawings, in which.

DESCRIPTION OF THE PREFERRED EMBODIMENTS

In the case of a color transition there are four possible situations for a pile thread:

Situation 1: A pile thread 18, 22 bound into the top fabric before the transition becomes active pile after the transition.

Situation 2: A pile thread 16, 20 bound into the bottom fabric before the transition becomes active pile after the transition.

Situation 3: A pile thread 15, 21 active before the transition is bound into the bottom fabric after the transition.

Situation 4: A pile thread 17, 19 active before the transition is bound into the top fabric after the transition.

Figure 10:
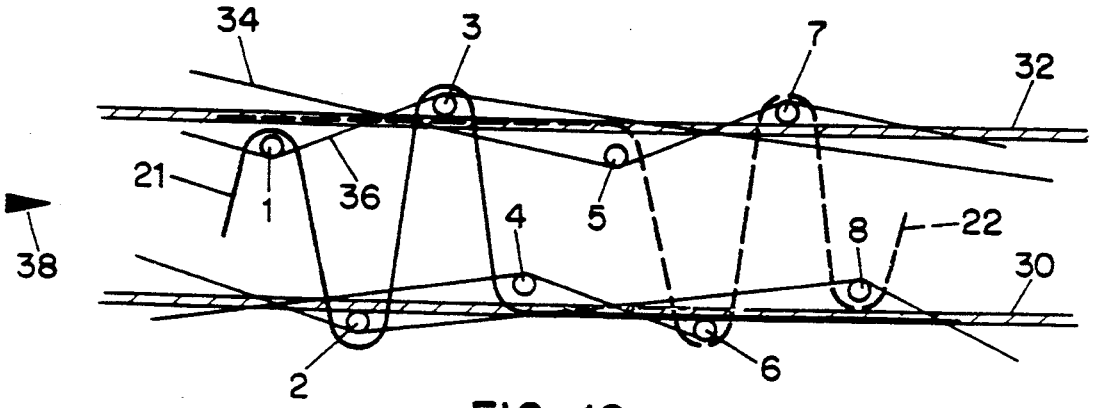
FIG. 10 shows in a diagrammatic cross-section of the fabric a color transition through the transition from an active pile thread which is subsequently bound into the bottom fabric to an active pile thread which was previously bound into the top fabric.

Four different transitions can consequently occur in the case of a color transition:

1° situation 1 becomes situation 3 (see FIG. 10)

Figure 2:
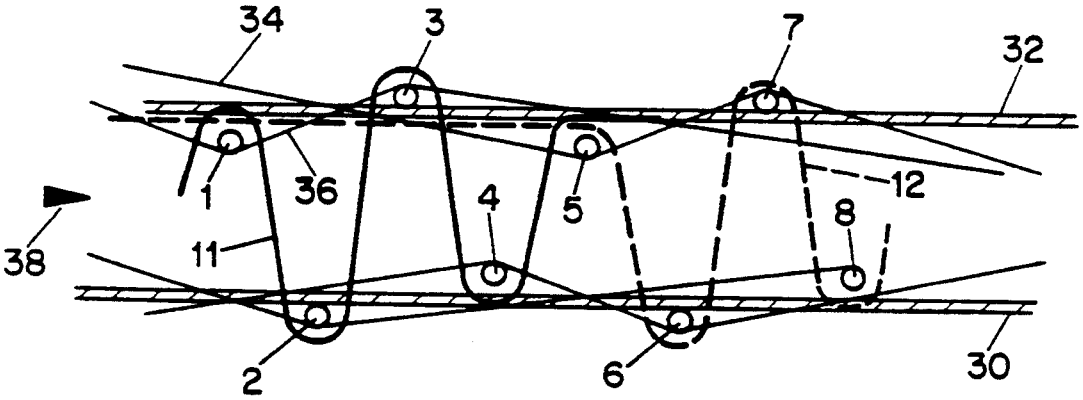
FIG. 2 PRIOR ART
FIG. 2 shows a cross-section of a second prior art weave.
Figure 7:
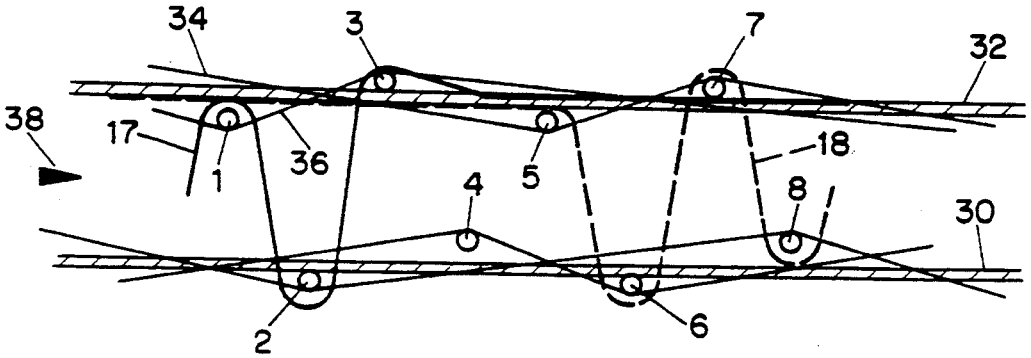
FIG. 7 shows in a diagrammatic cross-section of the fabric the new weave according to the invention for an active pile thread which is bound into the top fabric after the color transition.

2° situation 1 becomes situation 4 (see FIG. 2 and FIG. 7)

Figure 1:
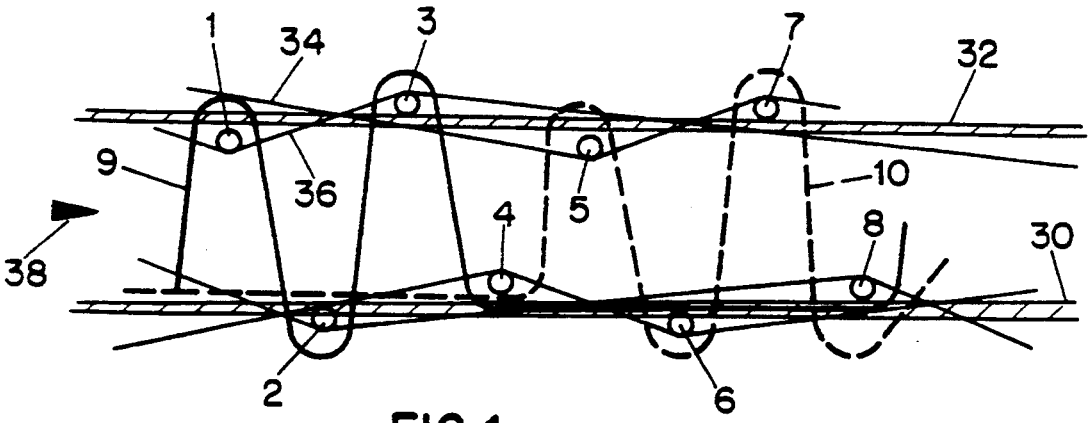
FIG. 1 PRIOR ART
FIG. 1 shows a cross-section of a first prior art weave.
Figure 6:
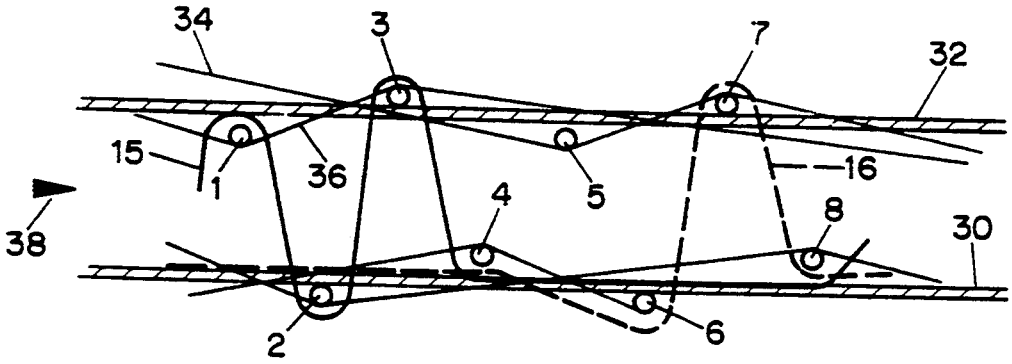
FIG. 6 shows in a diagrammatic cross-section of the fabric the new weave according to the invention for an active pile thread which was bound into the bottom fabric before the color transition.

3° situation 2 becomes situation 3 (see FIG. 1 and FIG. 6)

Figure 4:
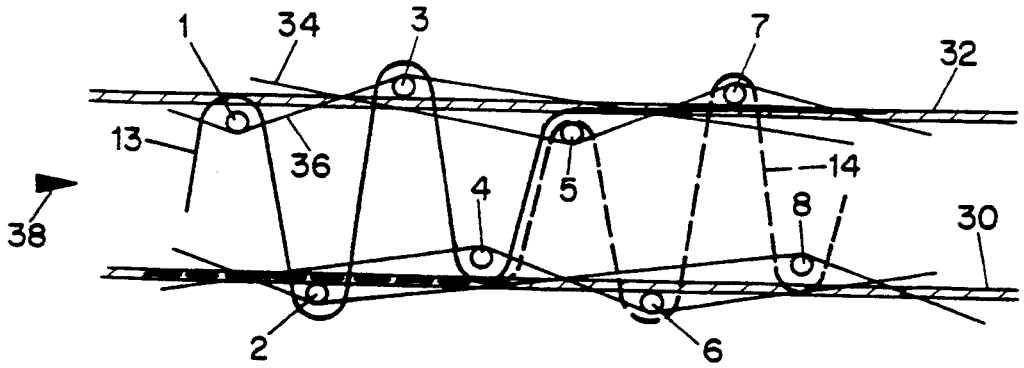
FIG. 4 PRIOR ART
FIG. 4 shows a cross-section of a third prior art weave.
Figure 5:
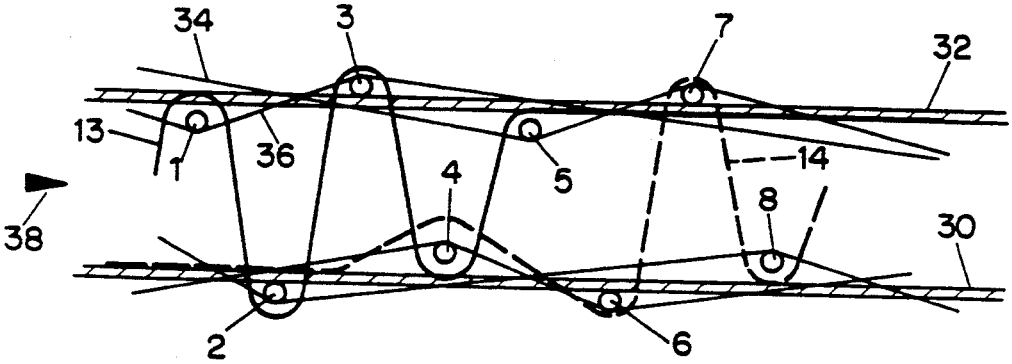
FIG. 5 PRIOR ART
FIG. 5 shows a cross-section of a fourth prior art weave.
Figure 9:
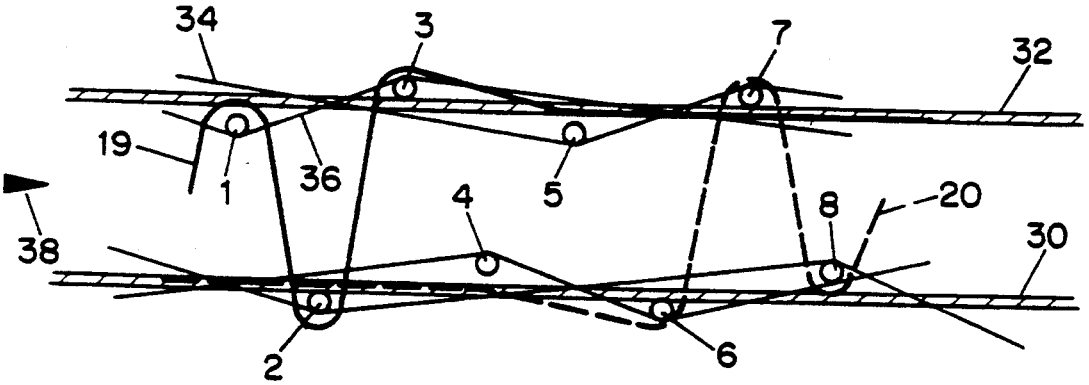
FIG. 9 shows in a diagrammatic cross-section of the fabric the new weaves according to the invention for a color transition through the transition from an active pile thread which is subsequently bound into the top fabric to an active pile thread which was previously bound into the bottom fabric.

4° situation 2 becomes situation 4 (see FIGS. 4, 5 and FIG. 9).

In the case of the ordinary weaves (see FIGS. 1, 2 and 4) the pile threads take up the following positions relative to the weft threads:

The active pile threads which are bound into the top fabric and into the bottom fabric: ABAB;

The bound-in pile threads in the top fabric: AABA;

The bound-in pile threads in the bottom fabric: BABB.

These ordinary weaves are shown in FIGS. 10, 1, 2 and 4 for the respective transitions from situation 1 to situation 3, from situation 1 to situation 4, from situation to situation 3, and from situation 2 to situation 4.

Only in the case of the first-mentioned transition —situation 1 to situation 3—(FIG. 10) does no color mixing take place. In the case of the other three transitions (FIGS. 1, 2 and 4) we have color mixing in each case. This color mixing is avoided by providing a different weave of the pile threads at the level of the transition, instead of the ordinary weaves mentioned above.

These new weaves are shown in FIGS. 6, 7 and 9 for the respective transitions from situation 2 to situation 3, from situation 1 to situation 4, and from situation 2 to situation 4. These new weaves are characterized in that the successive positions of an active pile thread relative to the weft threads in the situations shown are as follows:

For an active pile thread which is bound into the top fabric after the four shots indicated (=situation 4): ABAA;

For an active pile thread which is bound into the bottom fabric before the four shots indicated situation 2): BBAB.

In FIG. 6 (improvement of FIG. 1) pile thread 16 is bound into the bottom fabric before the color transition (situation 2). This pile thread 16 runs below shot 5, below shot 6, above shot 7 and below shot 8, (BBAB) according to the new weave according to the invention. As is inherent in the inventive arrangement of FIG. 6, there is no color mixing between shots 4 and 6, particularly directly below shot 4, however, because shot 4 tends to lie above shot 2.

In FIG. 7 (improvement of FIG. 2) active pile thread 17 is bound into the top fabric after the color transition (situation 4). This pile thread 17 runs above shot 1, below shot 2, above shot 3 and above shot 4 (ABAA) according to the new weave according to the invention.

In FIG. 9 (improvement of FIG. 4) the pile thread 20 active after the transition is bound into the bottom fabric before the color transition (situation 2), and active pile thread 19 is bound into the top fabric after the color transition (situation 4). Pile thread 19 runs above shot 1, below shot 2, above shot 3, and above shot 4, (ABAA), according to the new weave according to the invention.

Pile thread 20 runs below shot 5, below shot 6, above shot 7, and below shot 8, (BBAB) according to the new weave according to the invention.

If we look at the respective adapted weaves compared with the original weaves (compare FIG. 2 and FIG. 7, FIG. 1 and FIG. 6, FIG. 4 and FIG. 9), we can see that no more color mixing takes place in the case of the weaves according to the invention. This will be apparent from a comparison of the prior art weave shown in FIGS. 2 and 3 with the inventive weave shown in FIGS. 7 and 8.

Figure 3:
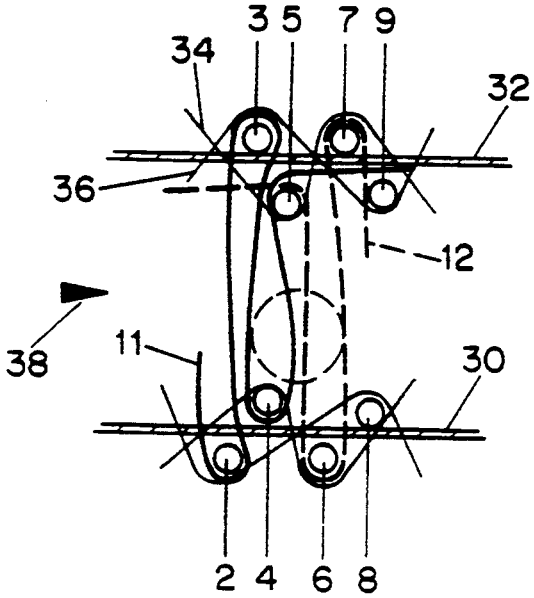
FIG. 3 PRIOR ART
FIG. 3 shows a fragmentary cross-section of the prior art weave shown in FIG. 2.

FIG. 3 shows a single-spool woven face-to-face fabric with a 1/1 V-weave for the active pile threads in which pile thread 11 which was active over shots 2, 3, 4 and 5 is bound into the top fabric 32 after shot 5, and another pile thread 12 which was previously bound into the top fabric 32 becomes active pile thread after shot 5. As a consequence, adjacent legs of pile threads 11 and 12 of different color, the legs identified by a dotted-line circle, are not separated by a weft. Accordingly, when the top 32 and bottom 30 fabrics are separated by cutter blades 38, both pile threads appear adjacent each other in both the top and bottom fabrics, meaning that color mixing occurs at that point in both fabrics.

Figure 8:
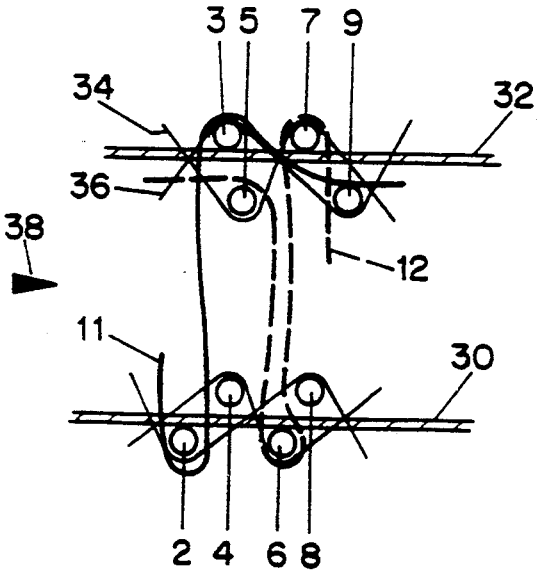
FIG. 8 shows a fragmentary cross-section of the new weave shown in FIG. 7.

FIG. 8 shows a portion of the improved weave of FIG. 7 in which active pile thread 11 (which corresponds to thread 17 in FIG. 7) is bound into the top fabric 32 after the color transition, that is, pile thread 11 runs below shot 2, above shot 3 and above shot 4 (ABAA) and then bound into the upper fabric, and pile thread 12 (which corresponds to thread 18 in FIG. 7) which was previously bound into the top fabric 32 becomes active pile thread after shot 5, running over shot 5, under shot 6, over shot 7 and under shot 8. In this case, the legs of adjacent pile threads between shots 5 and 7 are of the same color, meaning that there will be no color mixing at that point when the top and bottom fabrics are separated by cutter blades 38.

The proposed weaves according to the invention thus ensure that two different colors never occur between two inner shots. In fact, pile is formed only on the outer shots.

In order to achieve these adapted weaves, action is taken in the lift plan at the places where a color transition is taking place. By way of explanation, the pattern of a carpet is resolved in color points on a paper divided into a number of rows (strokes) and columns (chords); an intersection of a row and a column represents a color point. Each color point represents an effect in the carpet: a red point, for example, means pile frame 1 should form a pile tuft. Each row (stroke) is extended over a number of picks in a certain repeat (e.g., 4) and each column (cord) is extended to a number of frames (e.g., 5), the extension being done by automatic data processing in a computer. The lift plan is thus a graphic representation of the position of the pile ends in relation to the weft. It is used to punch the paper card or to prepare the data file for controlling the Jacquard head. For the plain color surfaces themselves the ordinary basic lift plan is used (according to the ordinary weaves).

The advantage of the invention lies in the elimination of the color mixing at the level of the color transitions, with the result that the alignment between the different color fields is improved, while the method used has no adverse effect whatsoever on the appearance of the fabric.

However, if one wishes to use the weaves according to the invention for weaving mix effects (mixing of two colors in linen), this results in a low pile density, due to the fact that pile is formed only every second shot. This problem can be solved by regarding this mix as a separate color, and using the non-adapted weaves for it, and thus providing the non-adapted basic lift plan.

I claim:

1. Method for single-spool weaving which avoids color mixing at color transitions when weaving a face-to-face fabric with bound-in dead pile bound by inner and outer weft threads alternately disposed in top and bottom fabrics, the inner weft threads of which are located at successive inner shots numbered 1, 4, 5, and 8, said inner shots disposed between said top and bottom fabrics, and the outer weft threads of which are located at successive outer shots numbered 2, 3, 6 and 7, said outer shots disposed outside said top and bottom fabrics, wherein a color transition in the fabric occurs at said shot 4 when a pile thread is bound into the bottom fabric before the transition and becomes an active pile thread after the transition, said method including the step of guiding said active pile thread below at least said inner shot 4, said inner shot 5, and said outer shot 6 before guiding it over said outer shot 7 to avoid color mixing at said color transition.

2. Face-to-face fabric with bound-in dead pile produced by the method according to claim 1.

3. Method for single-spool weaving which avoids color mixing at color transitions when weaving a face-to-face fabric with bound-in dead pile bound by inner and outer weft threads alternately disposed in top and bottom fabrics, the inner weft threads of which are located at successive inner shots numbered 1, 4, 5 and 8, said inner shots disposed between said top and bottom fabrics, and the outer weft threads of which are located at successive outer shots numbered 2, 3, 6 and 7, said outer shots disposed outside said top and bottom fabrics, wherein a color transition in the fabric occurs at said shot 4 when a pile thread is bound into the bottom fabric by weft threads 1, 2, 3 and 4 before the color transition, and becomes an active pile thread after the transition, said method including the step of guiding said active pile thread successively below said shot 4, below said shot 5, below said shot 6, above said shot 7 and below said shot 8 to avoid color mixing at said color transition.

4. Face-to-face fabric with bound-in dead pile produced by the method according to claim 3.

5. Method for single spool weaving which avoids color mixing at color transitions when weaving a face-to-face fabric with bound-in dead pile bound by inner and outer weft threads alternately disposed in top and bottom fabrics, the inner weft threads of which are located at successive inner shots numbered 1, 4, 5, and 8, said inner shots disposed between said top and bottom fabrics, and the outer weft threads of which are located at successive outer shots numbered 2, 3, 6 and 7, said outer shots disposed outside said top and bottom fabrics, wherein a color transition in the fabric occurs at said shot 4 when a pile thread which is active before the transition and is bound into the top fabric after the transition, said method including the step of guiding said active pile thread above at least said outer shot 3 and said inner shot 4 before it is bound into said top fabric to avoid color mixing at said color transition.

6. Face-to-face fabric with bound-in dead pile produced by the method according to claim 5.

7. Method for single spool weaving which avoids color mixing at color transitions when weaving a face-to-face fabric with bound-in dead pile with bound-in dead pile bound by inner and outer weft threads alternately disposed in top and bottom fabrics, the inner weft threads of which are located at successive inner shots numbered 1, 4, 5 and 8, said inner shots disposed between said top and bottom fabrics, and the outer weft threads of which are located at successive outer shots numbered 2, 3, 6 and 7, said outer shots disposed outside said top and bottom fabrics, wherein a color transition in the fabric occurs at said shot 4 when a pile thread which is active before the transition and is bound into the top fabric after the transition by weft threads at said shots 5, 6, 7 and 8, said method including the step of guiding said thread, prior to the transition, successively above said shot 1, below said shot 2, above said shot 3 and above said shot 4 to avoid color mixing at said color transition.

8. Face-to-face fabric with bound-in dead pile produced by the method according to claim 7.

* * * * *